US006318000B1

(12) United States Patent
Satake et al.

(10) Patent No.: US 6,318,000 B1
(45) Date of Patent: Nov. 20, 2001

(54) CIRCULATING TYPE GRAIN DRYING MACHINE

(75) Inventors: Satoru Satake, Tokyo; Hideaki Matsushima, Hiroshima; Toshinori Matsumoto, Hiroshima; Hidenori Mizuno, Hiroshima, all of (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 09/640,372

(22) Filed: Aug. 17, 2000

(30) Foreign Application Priority Data

Aug. 24, 1999 (JP) ..... 11-237643

(51) Int. Cl.[7] ..... F26B 17/12

(52) U.S. Cl. ..... 34/168; 34/446; 34/491

(58) Field of Search ..... 34/86, 495, 168, 34/170, 167, 65, 550, 531, 446, 491, 554, 218, 551, 557, 546; 126/117; 460/7

(56) References Cited

U.S. PATENT DOCUMENTS

| | | | | |
|---|---|---|---|---|
| 3,714,818 | | 2/1973 | Relph . | |
| 3,736,667 | * | 6/1973 | McClaren | 34/551 |
| 3,875,684 | * | 4/1975 | Henneman | 34/218 |
| 4,253,244 | * | 3/1981 | Kranzler | 34/554 |
| 4,263,722 | * | 4/1981 | Botkins et al. | 34/546 |
| 4,326,163 | | 4/1982 | Brooke . | |
| 4,402,302 | * | 9/1983 | Westelaken | 126/117 |
| 4,404,756 | * | 9/1983 | Noyes | 34/65 |
| 4,424,634 | * | 1/1984 | Westelaken | 34/167 |
| 4,485,284 | | 11/1984 | Pakulis . | |
| 4,558,523 | * | 12/1985 | Isbell et al. | 34/491 |
| 4,583,300 | * | 4/1986 | Mast | 34/557 |
| 4,916,830 | * | 4/1990 | Braun et al. | 34/550 |
| 4,994,286 | | 2/1991 | Greer . | |
| 5,002,788 | | 3/1991 | Satake . | |
| 5,092,819 | * | 3/1992 | Schroeder et al. | 460/7 |
| 5,106,339 | * | 4/1992 | Braun et al. | 460/7 |
| 5,119,571 | * | 6/1992 | Beasley | 34/446 |
| 5,167,081 | * | 12/1992 | Loyns | 34/170 |
| 5,194,275 | | 3/1993 | Greer . | |
| 5,467,535 | * | 11/1995 | Lentz | 34/168 |
| 5,651,193 | * | 7/1997 | Rhodes et al. | 34/531 |
| 5,708,366 | | 1/1998 | Nelson . | |
| 5,714,887 | | 2/1998 | Nelson . | |
| 5,829,160 | * | 11/1998 | Lange | 34/168 |
| 5,960,558 | * | 10/1999 | Bourgault | 34/495 |
| 6,209,223 | * | 4/2001 | Dinh | 34/86 |

FOREIGN PATENT DOCUMENTS

| | | | | |
|---|---|---|---|---|
| 2685222 | | 6/1993 | (FR) . | |
| 2650656 | * | 2/1991 | (FR) | F26B/17/12 |
| 03225192 | * | 10/1991 | (JP) . | |
| 6-86943 | | 3/1994 | (JP) . | |
| 1620127 | | 1/1991 | (SU) . | |
| WO9007110 | | 6/1990 | (WO) . | |

* cited by examiner

*Primary Examiner*—Teresa Walberg
*Assistant Examiner*—Leonid M Fastovsky
(74) *Attorney, Agent, or Firm*—Fish & Richardson P.C.

(57) ABSTRACT

The circulating type grain drying machine is provided in which, at the grain filling operation, a controller causes a first heated air generator to operate and a second heated air generator to stop operating, and also causes, according to the detected values of the outside air humidity from an outside air humidity detector, an airflow control section to operate so as to change the quantity of the airflow by an air exhaust section. Also, at the drying operation, the controller controls the first heated air generator and controls the temperature of the heated air supplied into each heating pipe according to the detected values of the grain water content value, and controls the second heated air generator and controls the temperature of the temperature of the heated air supplied into the drying section according to the detected values of the grain water content values and the grain filling amount.

4 Claims, 7 Drawing Sheets

CIRCULATING TYPE GRAIN DRYING MACHINE

BACKGROUND OF THE INVENTION (1) Field of the Invention

The present invention relates to a circulating type grain drying machine for drying grains, for example, an unhulled rice, wheat, etc.

(2) Description of the Related Art

Conventionally, there is a circulating type grain drying machine in which, for reducing the time required for drying, separately from a drying section for drying grains with heated air being supplied, there is provided a heating section for preliminarily increasing the temperature of grains (hereinafter referred to as a "grain temperature").

For example, Japanese Patent Application Kokai Publication No. Sho 62-9174 discloses a circulating type grain drying machine for providing preliminary heating to grains, which is provided, sequentially from the top thereof, with a reservoir section for temporarily keeping grains, a heating section having a plurality of heating pipes through which the heated air generated by one burner passes, and a drying section for drying the grains by heated air introduced from each of the heating pipes.

Also, Japanese Patent Application Kokai Publication No. Hei 2-309177 discloses a machine which is provided, sequentially from the top thereof, with a reservoir section, an upper drying section for effecting preliminary heating of grains equipped with a first burner, and a lower drying section for drying the grains also equipped with a second burner.

Further, Japanese Patent Application No. Hei 10-265486 in which the applicant is the same as in the present application discloses a machine which is provided, sequentially from the top thereof, with a reservoir section, a heating section for effecting preliminary heating of grains equipped with a plurality of heating pipes through which the heated air produced by a heating means passes, and a drying section for drying the grains by the heated air produced by a heating means provided separately from the above heating means.

In the above respective conventional circulating type grain drying machines, there are respectively the following problems:

With respect to the conventional machine disclosed in Japanese Patent Application Kokai Publication No. Sho 62-9174, the heated air generated by one burner passes through and heats each heating pipe and the heated air, after the heat is taken by the heating pipes with the heated air resulting in a lower temperature, is introduced into the drying section and serves as the heated air again for drying the grains. In order to introduce heated air of a predetermined temperature into the drying section, it is necessary to raise, according to the predetermined temperature, the temperature of the heated air for heating the heating pipes. Hence, in the disclosed machine, the heating pipes cannot be heated sufficiently. Also, since the heating temperature of the heating pipes and the heated air temperature of the drying section cannot be controlled separately, a drying efficiency may not be satisfactory.

In the conventional machine disclosed in Japanese Patent Application Kokai Publication No. Hei 2-309177, the drying is carried out by supplying to the grains in the upper drying section the heated air of high temperature and of small amount of airflow and, after the grain temperature has been raised, the grains are then subjected to the heated air of low temperature and of large amount of airflow in the lower drying section. Since the grains are exposed to the heated air for a long time at both the upper and lower drying sections, the quality of the grains will be affected and aggravated. Also, since the upper drying section and the lower drying section are provided respectively with separate burners, the quality deterioration of grains as mentioned above is caused thereby and, since the heated air at the upper drying section is not utilized in the lower drying section, the drying efficiency will not be satisfactory and the improvement is desired.

In the machine disclosed in Japanese Patent Application No. Hei 10-265486, the heating section and the drying section are respectively provided with heating means. After the grains are subjected to a preliminary heating through the heating pipes heated up to a predetermined temperature by the heating means of the heating section, the heated air which is produced separately from the above heating means and which is lower than the grain temperature is supplied to the grains in the drying section whereby the grains are efficiently dried while the quality deterioration is being prevented. However, in this drying machine, the heating temperature of the heating pipes is set to a predetermined constant temperature, and the heated air supplied to the drying section is made lower than only the grain temperature produced by the heating section. Thus, the arrangement was not one in which, in consideration of the grain water content which varies as the drying operation progresses, the heating temperature of the heating pipes and the heated air temperature supplied to the drying section are respectively controlled to optimum temperatures. Also, the heating section and the drying section are provided with separate heating means, and the heated air of the heating section is simply exhausted to outside the drying machine. Thus, the improvement is desired in the aspect of the drying efficiency.

SUMMARY OF THE INVENTION

In view of the problems in the conventional circulating type grain drying machines explained above and in order to further reduce the drying time and to enhance the drying efficiency, the inventors of the present invention aim at providing an improved circulating type drying machine with which the drying time is reduced and in which the first object is to enable the preliminary heating of the grains starting from the time of the grain filling operation, and the second object is to enable the separate controlling of the heated air temperature of the heating section and the heated air temperature of the drying section in accordance with the grain water content values during the drying operation while utilizing the heated air of the heating section.

According to one aspect of the invention, there is provided a circulating type grain drying machine, comprising:

- a heating section for heating grains equipped with a plurality of heating pipes through which heated air from a first heated air generating means passes;
- a drying section under the heating section, for drying grains by supplying heated air having passed through each heating pipe together with heated air from a second heated air generating means;
- an air exhaust means for sucking the heated air of the drying section and exhausting the heated air to outside the drying machine;
- an exhaust airflow control section for controlling the amount of exhaust air of the air exhaust means;
- an outside air humidity detection means for detecting an outside air humidity; and a control means electrically connected to each of the first heated air generating means, the second heated air generating means, the exhaust airflow control section, and the outside air humidity detection means, the control means causing, during the grain filling operation, the first heated air generating means to operate and at the same time the second heated air generating means to stop to operate, and the exhaust airflow control section to operate according to the detected outside air humidity value detected by the outside air humidity detection means and to change the exhaust airflow of the air exhaust means.

The control means causes the first heated air generating means to operate and the second heated air generating means to stop. The control means s ends a signal to the exhaust airflow control section operative according to the outside air humidity detected by the outside air humidity detection means and, by the operation of the exhaust airflow control section, the exhaust airflow from the air exhaust means is caused to be changed and the airflow in the drying section is changed. Thus, each heating pipe is heated by the heated air of the first heated air generating means, and the heated air turns to a low temperature resulting from the mixing with the outside air introduced through the second heated air generating means which is in a stopped state, and the low temperature heated air is introduced into the drying section. Since the amount of the exhaust air from the air exhaust means is changed by the exhaust airflow control section operated according to the outside air humidity, the airflow of the low temperature heated air introduced into the drying section is changed according to the outside humidity. Thus, while flowing down between the heating pipes, the grains introduced into the drying machine are heated by the heat conduction caused by being in contact with each heating pipe and by radiating heat of each heating pipe and, while flowing down through each grain flow-down layer, the grains are exposed to the heated air which is of a low temperature, which passes through each grain flow-down layer and the airflow of which is adapted to the outside humidity, the grains are heated without being dried. Thus, it is possible to effect the preliminary heating of the grains during the grain filling operation in advance to the drying operation.

If the grains are dried during the grain filling operation and such grains are mixed with the grains filled in the drying machine, there develops an uneven humidity state in the grains within the drying machine, which is unfavorable as it causes the grains to be unevenly dried during the subsequent drying operation.

The above circulating type grain drying machine is arranged such that the airflow of the drying section during the drying operation when the exhaust airflow is not restricted by the exhaust airflow control section is used as reference and, if the outside air humidity value is above a predetermined humidity, the airflow of the air in the drying section is caused to be a first airflow which is smaller than the reference and, if the outside air humidity value is below the predetermined value, the airflow of the air in the drying section is caused to be a second airflow which is still further smaller than the first airflow and, by the operation of the exhaust airflow control section, the exhaust airflow of the air exhaust means is caused to be changed.

Thus, by using the airflow in the drying section when the exhaust airflow is not restricted by the exhaust airflow control section as reference, the drying machine operates with the airflow of the drying section as the first airflow which is smaller than the reference and, when the humidity is below the predetermined humidity, operates with the airflow as the second airflow which is smaller than the first airflow, and the grains in the drying section are exposed to the airflow which is adapted to the outside humidity and to the heated air of a low temperature. Thus, the grains are heated without being dried at the drying section.

In the circulating type grain drying machine, it is preferable that the predetermined humidity is set to 70%.

Thus, the airflow in the drying section changes with the outside air humidity of 70% as the boundary line, the grains are heated without being dried.

According to another aspect of the invention, there is provided a circulating type grain drying machine, comprising:

a heating section for heating grains equipped with a plurality of heating pipes through which heated air from a first heated air generating means passes;

a drying section under the heating section, for drying grains by supplying heated air having passed through each heating pipe together with heated air from a second heated air generating means;

an air exhaust means for sucking the heated air of the drying section and exhausting the heated air to outside the drying machine;

a drying heated air temperature detecting means for detecting a temperature of the heated air supplied to the drying section;

a heating pipe heated air temperature detecting means for detecting a temperature of the heated air supplied to the heating pipes;

a water content detecting means for detecting water content values of grains;

an input section for inputting the amount of filled grains; and a control means electrically connected to each of the first heated air generating means, the second heated air generating means, the drying heated air temperature detecting means, the heating pipe heated air temperature detecting means, the water content detecting means and the input section, the control means controlling, during the drying operation, the first heated air generating means to change the temperature of the heated air supplied into each heating pipe according to the detected value of water content of the grains, and the second heated air generating means to change the temperature of the heated air supplied into the drying section according to the detected value of water content of the grains and the value of filled grains.

The control means controls the first heated air generating means based on the detected temperature value by the heating pipe heated air temperature detecting means so that the heated air supplied to the heating pipes becomes the temperature adapted to the grain water content value, the heating temperature of each heating pipe becomes the temperature adapted to the water content values of the grains. On the other hand, since the control means controls the second heated air generating means based on the detected heated air temperature value detected by the drying heated air temperature detecting means so that the heated air supplied to the drying section becomes the temperature adapted to the grain water content value and the grain filling amount, the heated air introduced into the drying section and passed through each heating pipe is mixed with the outside air in-taken from the outside air in-taking opening and becomes the temperature adapted to the water content values and the grain filling amount. Further, the heating temperature of each heating pipe and the heated air temperature of the drying section are of temperatures which do not cause the deterioration of the grains such as by cracks. Thus, the grains filled in the drying machine are preliminary heated by each heating pipe heated by the temperature which is varied as the drying progresses and which is adapted to the water content of the grains. The preliminarily heated grains flow down into the drying section and, at the drying section, the heated air of the temperature adapted to the grain water content value and to the grain filling amount, thereby enabling the efficient drying operation and also enabling the reduction in the drying time as compared with that in the conventional machine.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

With reference to FIGS. 1–6, hereinafter explained are a construction of one exemplified joint-use grain drying and regulating installation, a configuration of a circulating type grain drying machine used in the installation, a method of grain filling and controlling operations, and a method of drying and controlling operations.

Figure 1:
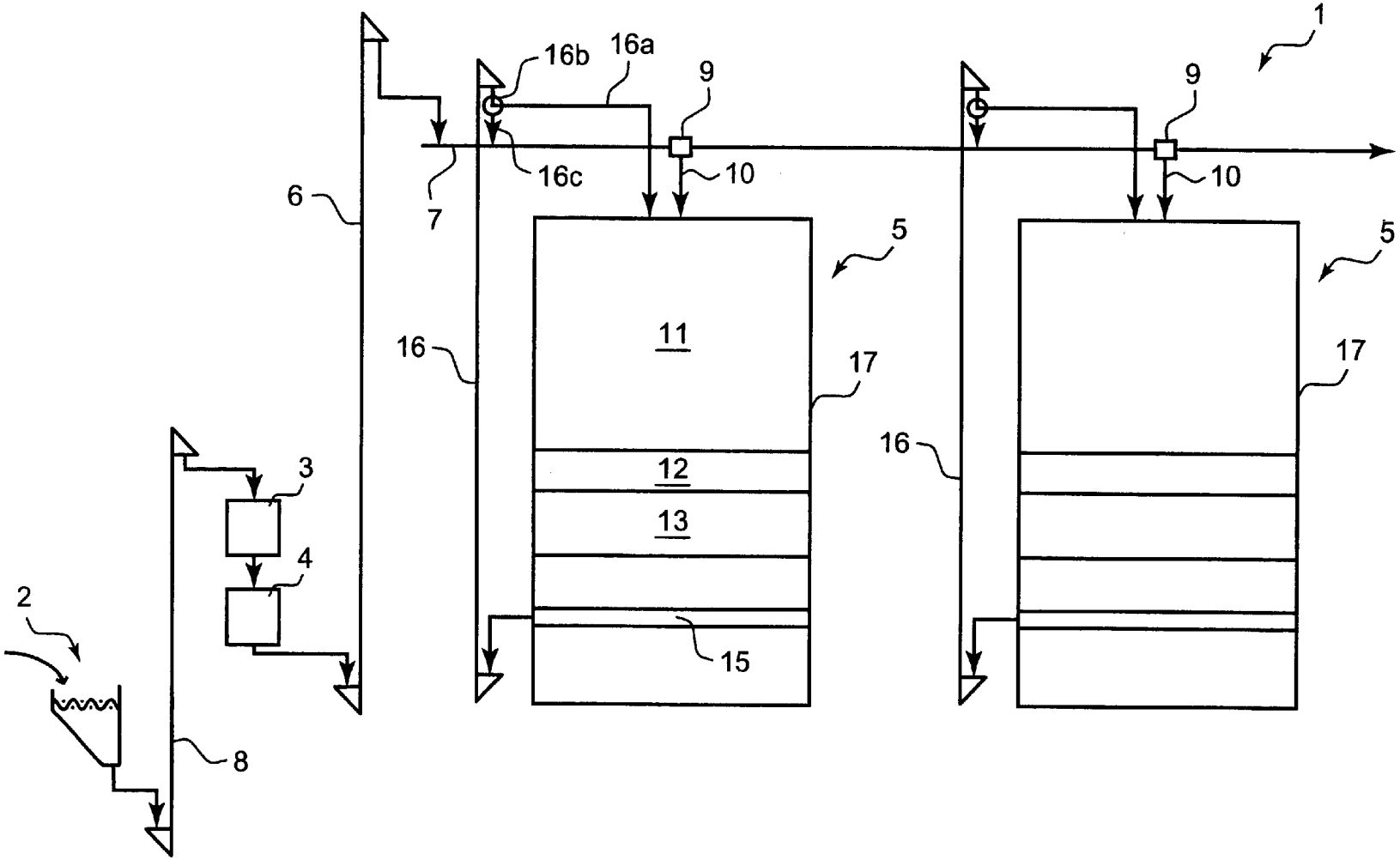
FIG. 1 is a view showing main elements of one example of a joint-use grain drying and regulating installation according to the invention.

First, FIG. 1 shows main elements of the above mentioned joint-use grain drying and regulating installation.

The joint-use grain drying and regulating installation 1 is equipped with a grain receiving section 2, a rough sorter 3, a scale 4, a plurality of circulating type drying machines 5, a hull removing/fine sorting section (not shown), a silo (not shown) and an air exhaust means. The grain receiving section 2 is communicated to the rough sorter 3 through an elevator 8. The rough sorter 3 is communicated to the scale 4 arranged under the rough sorter 3. The scale 4 is communicated to a horizontal conveyor 7 provided over each drying machine 5 through an elevator 6. The horizontal conveyor 7 is provided with, at a location of each drying machine, a shutter section 9 which is used when the grains are supplied into each drying machine 5. Each shutter section 9 and an upper portion of each drying machine 5 are communicated with each other through a feeding pipe 10.

Figure 2:
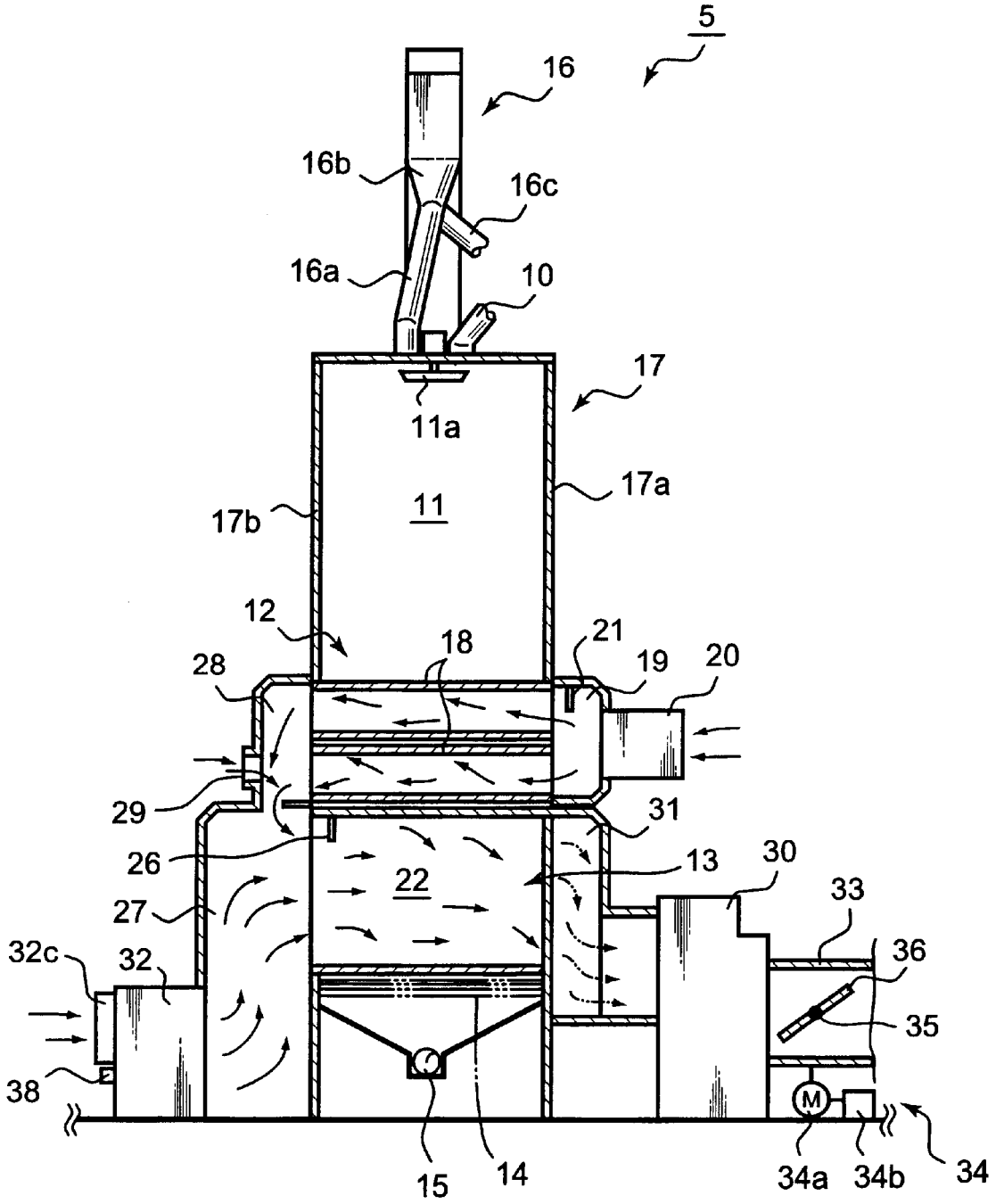
FIG. 2 is a front view showing a circulating type grain drying machine, partially in section, according to the invention.
Figure 3:
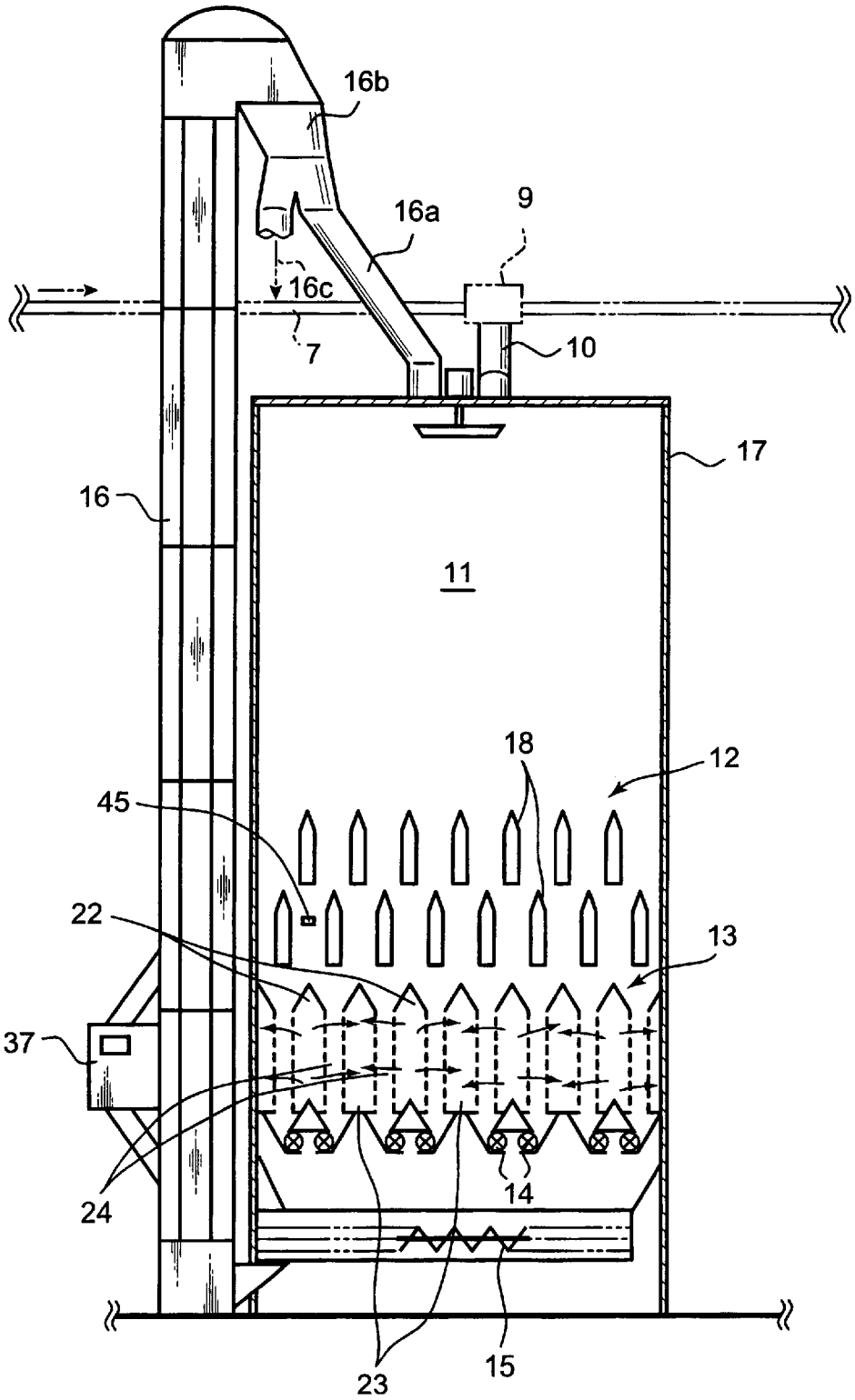
FIG. 3 is a side view showing a circulating type grain drying machine, partially in section, according to the invention.
Figure 4:
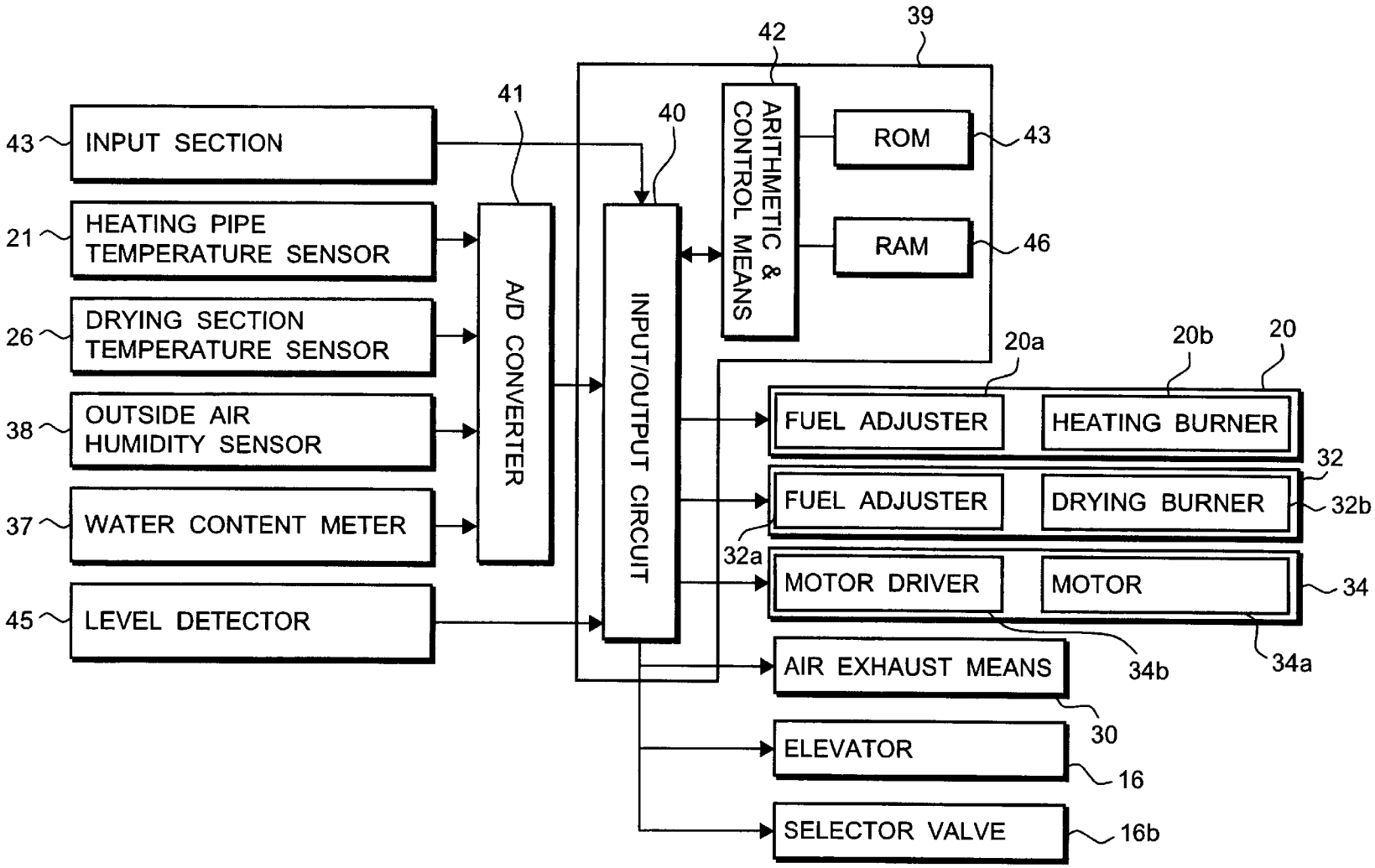
FIG. 4 is a control block diagram for controlling a circulating type grain drying machine according to the invention.

Next, structural arrangements of the circulating type drying machine 5 are explained with reference to FIGS. 2 and 3. FIG. 2 is a front view, partially in section, of the machine, and FIG. 3 is a side view, also partially in section, of the machine. Here one representative drying machine 5 is explained. The drying machine 5 is provided with, sequentially from the top thereof, a reservoir section 11 for storing grains, a heating section 12 for providing preliminary heating to the grains, a drying section 13 for drying the grains by heating air, a forwarding valve 14 for forwarding the grains, and a screw conveyor 15 for discharging the grains to the conveying starting end at a lower portion of the elevator 16 explained later.

The heating section 12 is provided with a plurality of heating pipes 18 upper and lower ones of which are horizontally provided in a staggered form. On the other hand, at one side 17*a* of the body 17 of the drying machine, there is provided a first heated air generating means 20 (hereinafter referred to as a "heating burner section") which is communicated to the heated air supplying side of each heating pipe 18 through a leading-in path 19. Within the leading-in path 19, there is provided a heating pipe temperature sensor 21 for detecting the temperature of the heated air supplied to each heating pipe 18. Further, the heating burner section 20 is equipped with the heating burner 20*b* which uses kerosene as fuel, and with a fuel adjusting circuit 20*a* which adjusts the amount of fuel supplied to the heating burner 20*b*. Also, between the lower level heating pipes 18, 18 opposing with each other, there is provided a level detector 45 which detects presence or non-presence of the grains.

The drying section 13 has a plurality of heated air paths 22 and a plurality of air exhaust paths 23. The heated air paths 22 and the air exhaust paths 23 are alternately provided in a row. The side surfaces of the heated air paths 22 and the air exhaust paths 23 are respectively formed by perforated plates so that the heated air is allowed to pass therethrough, and there is a grain flow-down layer 24 between the adjacent ones of the heated air paths 22 and the air exhaust paths 23. At an upper portion of the heated air leading-in side of the heated air path 22, there is provided a drying section temperature sensor 26 for detecting the temperature of the heated air. At the other side 17*b* of the main body 17 of the drying machine, there is provided a second heated air generating means 32 (hereinafter referred to as a "drying burner section") which communicates with the heated air supplying section of each of the heated air paths 22 through a leading-in path 27. Further, the drying burner section 32 is equipped with a drying burner 32*b* which uses kerosene as fuel and with a fuel amount adjusting circuit 32*a* for adjusting the amount of the fuel supplied to the drying burner 32*b*.

The exhaust side of the heated air of each heating pipe 18 is communicated through the leading-in path 28 so that the heated air passing through each of the heating pipe 18 is led-in the leading-in path 27, and the leadingin path 28 is equipped with an outside air taking-in opening 29 for taking-in the outside air. On one hand, at the one side 17*a* of the main body 17 of the drying machine, there is provided an air exhaust means 30. The air exhaust means 30 communicates with the heated air exhausting side of each of the air exhaust paths 23 through a leading-in path 31. The air exhaust means 30 is connected through an air exhaust pipe 33 to an exhaust air treating means (not shown) for treating the exhaust air containing dust. In the vicinity of a location at which the exhaust pipe 33 and the air exhaust mean 30 are connected with each other, there is provided an exhaust airflow control section 34. The exhaust airflow control section 34, in this preferred embodiment, is provided with an airflow restricting plate 36 which rotates around a shaft 35, a motor 34*a* which rotates the shaft 35 and a motor driving circuit 34*b*.

A plurality of forwarding valves 14 are provided with each of them being in a corresponding relation with respect to each of the grain flow-down layers 24. Below each of the plurality of forwarding valves 14, there is provided a screw conveyor 15.

The elevator 16 stands at the side of the main body 17 of each drying machine 5. The elevator 16 is communicated with the discharging side of the screw conveyor 15 at the conveying starting end side at the lower portion, and the conveying finishing end side at the upper portion is communicated with the reservoir section 11 through a circulating pipe 16*a*. The circulating pipe 16*a* is equipped with a bi-directional valve, that is, a selector valve 16*b* which enables the selection either to the reservoir section 11 side or to the horizontal conveying machine 7 side. The horizontal conveying machine 7 side of the selector valve 16*b* is communicated with the horizontal conveying machine 7 through a pipe 16*c*. Further, at the lower portion of each elevator 16, there is provided a humidity meter 37 for detecting the moisture content (water content value) of the grain which is taken from within the elevator 16.

Under the circulating pipe 16*a* and the feeding pipe 10 at the inner side of the ceiling of the main body 17 of the drying machine, there is provided a scattering plate 11*a* for scattering the grains supplied from each of the pipes 16*a*, 10. Also, at the air in-taking side of the drying burner section 32, there is provided an outside air humidity sensor 38 for detecting the humidity of the outside air.

Next, the configuration of the control means 39 of the circulating type drying machine 5 described above is explained with reference mainly to FIG. 4. The control means 39 has an arithmetic and control section 42 having CPU as its central or main component, and electrically connected to the arithmetic and control section 42 are an input/output circuit 40, a ROM 43 (read-only memory) for storing data, program, etc. and a RAM 46 (random access memory) for storing data. The input/output circuit 40 is electrically connected, through an A/D converter 41 for converting an analog signal to a digital signal, to respectively the heated air pipe temperature sensor 21, the drying section temperature sensor 26, the outside air humidity sensor 38 and the humidity meter 37. Also, the input/output circuit 40 is electrically connected to respectively the input section 43, the heating burner section 20, the drying burner section 32, the level detector 45, the exhaust airflow control section 34, the air exhaust means 30, the elevator 16 and the selector valve 16*b*. The input section 43 selects and sets the quantity of the grains to be introduced (filling amount or quantity) into the main body 17 of the drying machine, the targeted water content value of the grains, and the operating modes for grain filling operation, drying operation, etc.

Next, explanation is made on the control of the grain filling operation and the control of the drying operation in the circulating type grain drying machine 5 used at the joint-use grain drying and regulating installation 1. The explanation is made for one drying machine 5 representatively and no explanation is repeated for other drying machines 5.

First, the explanation is made on the function relating to the introduction, into the circulating type grain drying machine 5, of the grains received at the joint-use grain drying and regulating installation 1. The grains charged at the grain receiving section 2 are forwarded to the horizontal conveyor 7 through the elevator 8, the rough sorter 3, the scale 4 and the elevator 6. Then, the grains are conveyed to above the drying machine 5 to which the grains are to be introduced. The grains are introduced into the main body 17 of the drying machine from the shutter section 9 which stands-by in an open state.

Figure 5:
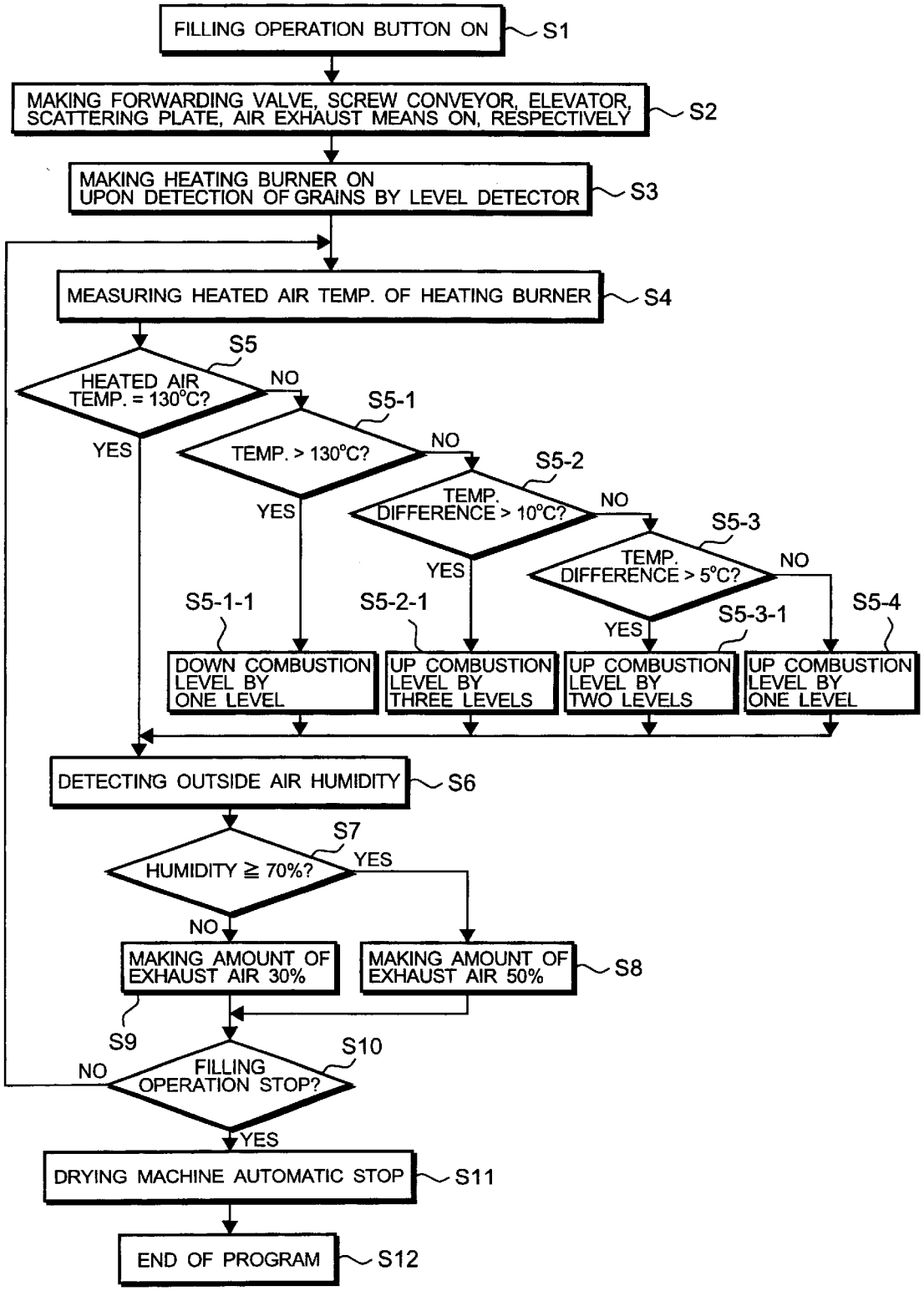
FIG. 5 is a flow chart of grain filling operation and controlling of a circulating type grain drying machine according to the invention.

Next, the control of the grain filling operation of the circulating type grain drying machine 5 is explained with reference of the flow-chart in FIG. 5. When the button for grain filling operation of the input section 43 is pressed, the signal is sent therefrom to the arithmetic and control section 42 through the input/output circuit 40. The arithmetic and control section 42 reads out the filling operation program stored in advance in the ROM 43 and starts the execution of the program and controls the subsequent steps (Step S1).

Then, the arithmetic and control section 42 starts the operation of the air exhaust means 30, the forwarding valve 14, the screw conveyor 15, the elevator 16 and the scattering plate 11*a*. In this way, the grains introduced into the main body 17 of the drying machine are forwarded downwardly from the forwarding valve 14 for allowing the grains to be circulated within the main body 17 of the drying machine, and the grains are then reintroduced into the main body 17 of the drying machine through the screw conveyor 15, the elevator 16, the selector valve 16*b* and the circulating pipe 16*a*. At this time, the selector valve 16*b* receives a signal from the arithmetic and control section 42 and the flow path has been changed over to the reservoir section 11 side (Step S2).

Next, when the grains accumulated in the main body 17 of the drying machine reach the level detector 45 and the presence of the grains is detected by the level detector 45, the arithmetic and control section 42 receives a signal from the level detector 45 through the input/output circuit 40. Upon receiving this signal, the arithmetic and control section 42 sends a signal to the heating burner section 20 whereby the heating burner 20*b* starts its operation (at this time, the drying burner section 32 remains in a stopped state) (Step S3).

The temperature of the heated air produced by the heating burner section 20 is detected by the heating pipe temperature sensor 21, and the detected temperature data are inputted into the arithmetic and control section 42 through the A/D converter 41 and the input/output circuit 40 (Step S4).

Next, at the Step S5, based on 130° C. which is set in advance in the ROM 43 and which is the heated air set temperature to be produced at the heating burner section 20 during the grain filling operation, the arithmetic and control section 42 determines whether the temperature of the heated air detected at the above Step S4 is "in accord" with 130° C. or not. If in the affirmative, the Step S6 is executed. If the temperature is "out of accord", the Step S5-1 is executed.

At the Step S5-1, whether the heated air temperature of the heating burner section 20 is above 130° C. is determined. If in the affirmative, the Step S5-1-1 is executed. If the temperature is lower than 130° C., the Step S5-2 is executed.

At the Step S5-1-1, the arithmetic and control section 42 sends a signal to the fuel adjusting circuit 20*a* for decreasing the combustion amount of the heating burner 20*b* by one level (one step) and, upon receiving this signal, the fuel adjusting circuit 20*a* causes the heating burner 20*b* to decrease the combustion amount of the heating burner 20*b* by one level.

At the Step S5-2, the arithmetic and control section 42 calculates the temperature difference between the detected heated air temperature and 130° C. and determines whether such temperature difference is larger than 10° C. If the difference is larger than 10° C., the Step S5-2-1 is executed. Conversely, if the difference is smaller than 10° C., the Step S5-3 is executed.

At the Step S5-2-1, the arithmetic and control section 42 sends a signal to the fuel adjusting circuit 20*a* for increasing the combustion amount of the heating burner 20*b* by three levels (three steps) and, on receiving this signal, the fuel adjusting circuit 20*a* causes the heating burner 20*b* to increase the combustion amount of the heating burner 20*b* by three levels.

At the Step S5-3, the arithmetic and control section 42 determines whether the above explained temperature difference is larger than 5° C. If the difference is larger than 5° C., the Step S5-3-1 is executed. Conversely, if the difference is smaller than 5° C., the Step S5-4 is executed.

At the Step S5-3-1, the arithmetic and control section 42 sends a signal to the fuel adjusting circuit 20*a* for increasing the combustion amount of the heating burner 20*b* by two levels (two steps) and, upon receiving this signal, the fuel adjusting circuit 20*a* causes the heating burner 20*b* to decrease the combustion amount of the heating burner 20*b* by two levels.

At the Step S5-4, the arithmetic and control section 42 sends a signal to the fuel adjusting circuit 20*a* for increasing the combustion amount of the heating burner 20*b* by one level (one step) and, upon receiving this signal, the fuel adjusting circuit 20*a* causes the heating burner 20*b* to increase the combustion amount of the heating burner 20*b* by one level.

After the above Step S5-1-1, Step S5-2-1, Step S5-3-1 and Step S5-4 have been executed, the Step S6 (detection of the outside air humidity) is executed.

At the Step S6, the outside air humidity data detected by the outside air humidity sensor 38 are inputted into the arithmetic and control section 42 through the A/D converter 41 and the input/output circuit 40.

Next, the arithmetic and control section 42 determines whether the outside air humidity (relative humidity) detected at the Step S6 is larger than 70%. If it is larger than 70%, the Step S8 is executed and, if it is smaller than 70%, the Step S9 is executed.

At the Step S8 (i.e., the outside air humidity being larger than 70%), the arithmetic and control section 42 sends a signal to the exhaust airflow control section 34 for changing the exhaust air amount at the air exhaust means 30 so as to cause the amount of the airflow in the grain flow-down layers 24 to be at a predetermined value. Specifically, where the outside air humidity (relative humidity) is larger than 70% when the airflow amount (e.g., 4~5 $m^3$/s per 1 ton of grains) of the drying section at the time of the drying operation when the exhaust air amount is not restricted by the exhaust airflow control section 34 is used as reference, the exhaust airflow amount is made 50% with respect to the exhaust airflow amount 100% as at the drying operation so that the airflow may be a first airflow amount (2~2.5 $m^3$/s per 1 ton of grains) which is smaller than the reference airflow amount mentioned above. Change in the exhaust airflow amount is effected by the arithmetic and control section 42 which sends a signal to a motor driving circuit 34*b* for operating the motor 34*a* and rotating the airflow restricting plate 36

At the Step S9 (i.e., when the outside air humidity is smaller than 70%), the arithmetic and control section 42 sends a signal to the exhaust airflow control section 34 whereby the exhaust airflow amount may be made 30% so that the airflow amount of the heated air at the drying section may be a second airflow amount (1.2~1.5 $m^3$/s per 1 ton of grains) which is smaller than the above-explained first airflow amount. The changing of the exhaust air amount is effected in the same way as in the Step S8.

The outside air humidity 70% has been used as reference for effecting changes in the airflow because, if the grains are exposed to the air having less than 70% of the humidity, the grains become dried. When the dried grains reflux into the drying machine by the elevator 16 and are mixed with the grains newly filled into the drying machine, the grains in the drying machine undergo non-uniform humidity which hinders uniform drying during the drying operation. Thus, in order to prevent the grains from becoming dried, the exhausting air amount is changed by the air exhaust means 30 so that the heated air at the drying section becomes the first airflow amount. On the other hand, if the grains are exposed to the air having more than 70% humidity, the grains are not dried so that, in order to make the heated air at the drying section the second airflow amount, the exhaust air amount is changed by the air exhaust means 30. In the above, the exhaust air amount of the air exhaust means 30 has been restricted to 30% or 50% for the airflow to be predetermined amount, but the exhaust air amount may be set appropriately so that the heated air at the drying section may become the first airflow or the second airflow with the boundary line being 70% of the outside air humidity. The decrease in the air-flow amount of the heated air at the drying section is due to the decrease in the suction power of the air exhaust means 30 whose air exhaust amount is lowered by the restriction at the exhaust airflow control section 34.

When the stop signal for stopping the grain filling operation is inputted to the arithmetic and control section 42 from the input section 43, the arithmetic and control section 42 automatically stops the operation of the drying machine 5 (Step S11) and finishes the filling operation program (Step S12). When the stop signal is not inputted, the procedure returns to the Step S4 (Steps S10 through S12).

As to the temperature of the heated air produced at the heating burner section 20 for the grain filling operation set in advance in the ROM 43, the temperature is not limited to the above mentioned 130° C. and it may be appropriately set. Further, it is possible to arrange that the grain temperature sensor for detecting the temperature of the grains be provided between the heating section and the drying section so that the heating burner section 20 may stop when the grain temperature reaches the predetermined temperature and, when the grain temperature is low, the heating burner section 20 is powered on.

According to the above steps, the heated air maintained at 130° C. from the heating burner section 20 passes through within each heating pipe 18 by the suction action of the air exhaust means 30 and, after heating each heating pipe 18 up to a predetermined temperature and after being mixed with the outside air from the outside air intake opening 29 in the leading-in path 28 thus the temperature being lowered, is led into the leading-in path 27. The heated air is also mixed with the outside air sucked into the leading-in path 27 through the outside air intake opening 32*c* of the drying burner section 32 in a stopped state so that the temperature is further lowered. Further, after being sucked into the air exhaust means 30 through each heated air path 22, each grain flow-down layer 24, each air exhaust path 23, and the leading-in path 31, the heated air is exhausted through the air exhaust pipe 33 while being restricted by the exhaust air-flow control section 34.

Thus, when the grains introduced into the main body 17 of the drying machine flow down between the respective heating pipes 18, the grains are heated by heat conduction resulting from being in touch with each heating pipe 18 and by radiant heat from each heating pipe 18 and, while flowing down through each grain flow-down layer 24, the grains are heated but without being dried by the heated air which passes through each grain flow-down layer 24 since such air is of a low temperature and of the airflow adapted to the outside air humidity. In this way, the grains are given preliminary heating during the grain filling operation in advance to the drying operation.

Figure 6A:
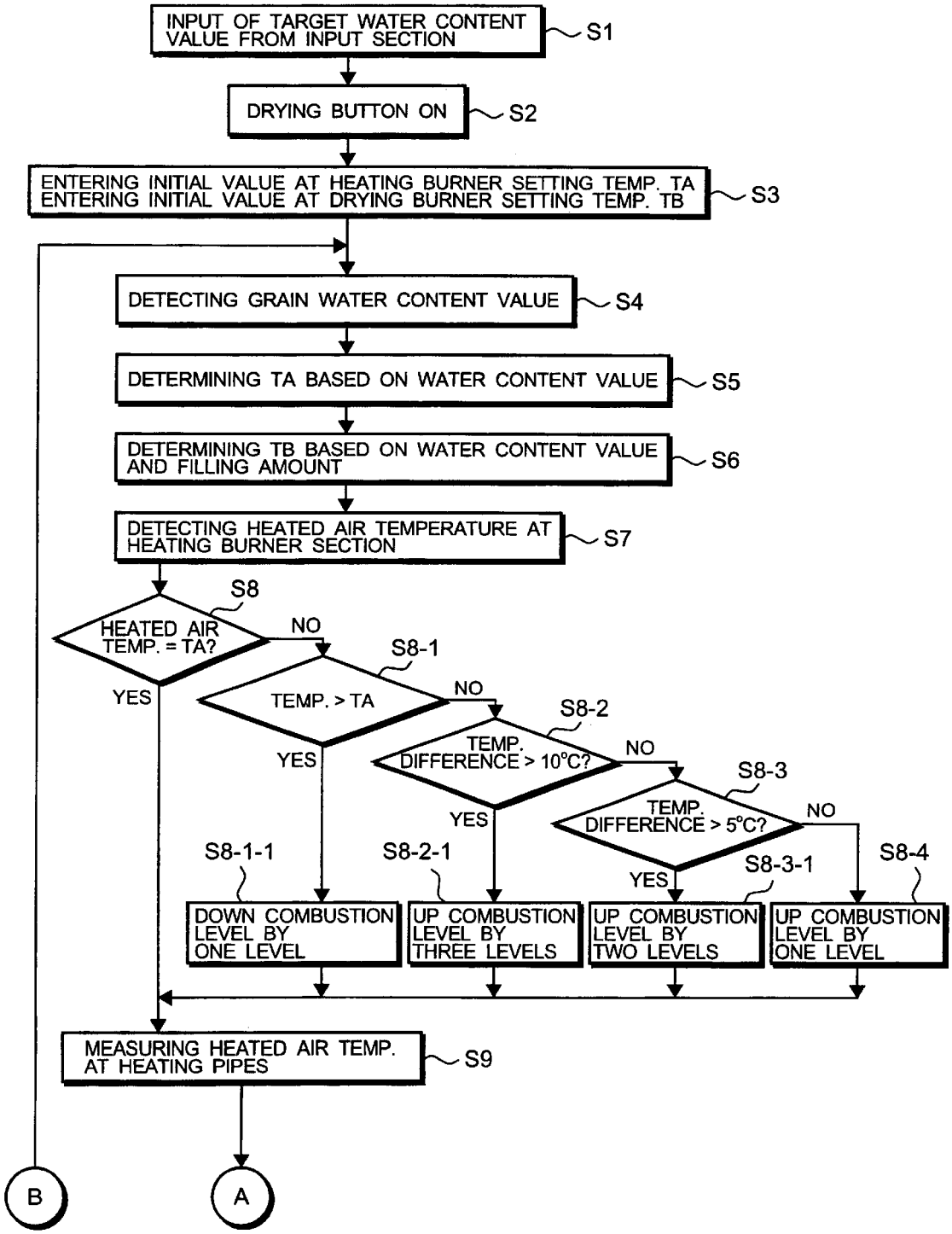
FIGS. 6(*a*) and 6(*b*) are flow charts of drying operation and controlling of a circulating type grain drying machine according to the invention.
Figure 6B:
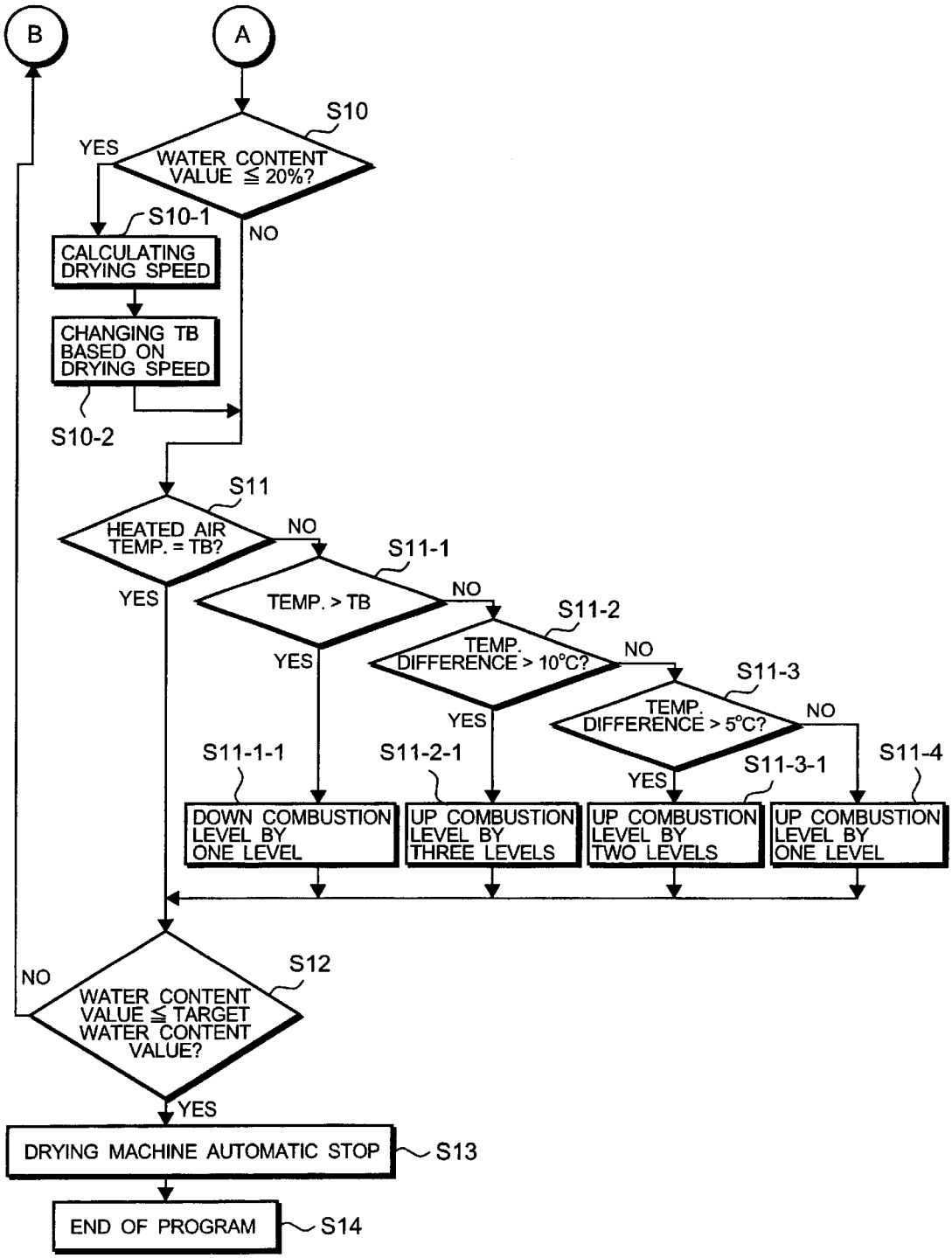

Now, hereinafter the drying operation control of the circulating type grain drying machine 5 is explained with reference to the flow charts of FIGS. 6(*a*) and 6(*b*). Symbols A, B in circles in FIG. 6(*a*) are respectively connected to symbols A, B in circles in FIG. 6(*b*). First, the operator sets and enters from the input section 43 the amount of grains (hereinafter referred to as a "filling amount") to be introduced into and accumulated in the main body 17 of the drying machine, the targeted finishing water content value, etc. This input signal is inputted through the input/output circuit 40 into the arithmetic and control section 42 which stores this input signal in the RAM 46 (Step S1).

Next, when the operator presses the button for the drying operation at the input section 43, the relevant signal is sent to the arithmetic and control section 42 through the input/output circuit 40. The arithmetic and control section 42 reads out the drying operation program stored in advance in the ROM 43 and starts the execution of the program. The arithmetic and control section 42 starts the respective operations of the scattering plate 11*a*, elevator 16, screw conveyor 15, forwarding valve 14, air exhaust means 30, heating burner section 20, and humidity meter 37. The heating burner section 32 is caused to be operated several minutes later. The exhaust airflow control section 34 is in a full admission, and the selector valve 16*b* changes its flow to the main body 17 side (Step S2).

Next, the arithmetic and control section 42 enters an initial value at the heated air setting temperature TA for the heating burner section 20, and also enters an initial value at the heated air setting temperature TB for the drying burner section 32 (Step S3).

Next, the humidity meter 37 detects a water content value (water content rate) of the grains supplied to the elevator 16 from the screw conveyor 15 and conveyed upwardly, and the detected values are taken into the arithmetic and control section 42 through the A/D converter 41 and the input/output circuit 40 and, thereafter, are stored in the RAM 46 (Step S4).

Then, based on the water content values of the grains detected in the Step S4, the arithmetic and control section 42 determines the heated air setting temperature TA of the heating burner section 20 at the temperatures as shown in the Table 1. For example, if the water content values of the grains are within the range of 21~25%, the heated air setting temperature TA is set to 130° C. and, if the water content values of the grains are within the range of 19~21%, the heated air setting temperature TA is set to 120° C. (Step S5).

TABLE 1

| | | | | WATER CONTENT OF GRAIN (%) | | | | |
|---|---|---|---|---|---|---|---|---|
| | | | | 15~17 | 17~19 | 19~21 | 21~25 | 25~30 |
| HEATED AIR TEMP. (° C.) | HEATING PIPES | | | 100 | 110 | 120 | 130 | 140 |
| | DRYING SECTION | FILLING AMOUNT | SMALL AMOUNT | 28 | 28 | 29 | 29 | 30 |
| | | | LEVEL 1 | 28 | 28 | 29 | 30 | 30 |
| | | | LEVEL 2 | 29 | 30 | 31 | 32 | 33 |
| | | | LEVEL 3 | 30 | 31 | 32 | 33 | 35 |
| | | | LEVEL 4 | 31 | 33 | 34 | 35 | 37 |
| | | | LEVEL 5 | 33 | 34 | 36 | 37 | 40 |
| | | | LEVEL 6 | 34 | 36 | 38 | 39 | 42 |
| | | | LEVEL 7 | 35 | 37 | 39 | 41 | 44 |
| | | | LEVEL 8 | 36 | 39 | 41 | 43 | 47 |

Then, based on the water content values in Step S4 and the filling amount stored in the RAM 46 in the Step S1, the arithmetic and control section 42 determines the setting temperature TB of the heated air supplied to each heated air path at the temperatures as shown in the Table 1. For example, if the water content values of the grains are within the range of 21~25% and the filling amount is at the level "6", the heated air setting temperature TB is set to 39° C. and, if the water content values of the grains are within the range of 19~21% and moreover the filling amount is at the level "6", the heated air setting temperature TB is set to 38° C. (Step S6).

Then, the heated air temperature of the heating burner section 20 is detected by the heating pipe temperature sensor 21, and the detected temperature data are entered into the arithmetic and control section 42 through the A/D converter 41 and the input/output circuit 40.

Next , the arithmetic and control section 42 determines whether the heated air temperature of the heating burner section 20 is "in accord" with the heating air setting temperature TA set in advance. If the result is "out of accord",the Step S8-1 is executed and, if the result is "in accord",the Step S9 is executed (Step S8).

At the Step S8-1, the determination is made as to whether the heated air from the heating burner section 20 is higher than the heated air setting temperature TA. If the heated air temperature is higher than the heated air setting temperature TA, the Step S8-1-1 is executed and, if the heated air temperature is lower than TA, the Step S8-2 is executed.

At the Step S8-1-1, the arithmetic and control section 42 sends a signal to the fuel adjusting circuit 20*a* for decreasing the combustion amount of the heating burner 20*b* by one level (one step) and, upon receiving this signal, the fuel adjusting circuit 20*a* causes the heating burner 20*b* to decrease the combustion amount of the heating burner 20*b* by one level.

At the Step S8-2, the arithmetic and control section 42 calculates the temperature difference between the detected heated air temperature and the heated air setting temperature TA and determines whether such temperature difference is larger than 10° C. If the difference is larger than 10° C., the Step S8-2-1 is executed. Conversely, if the difference is smaller than 10° C., the Step S8-3 is executed.

At the Step S8-2-1, the arithmetic and control section 42 sends a signal to the fuel adjusting circuit 20*a* for increasing the combustion amount of the heating burner 20*b* by three levels (three steps) and, on receiving this signal, the fuel adjusting circuit 20*a* causes the heating burner 20*b* to increase the combustion amount of the heating burner 20*b* by three levels.

At the Step S8-3, the arithmetic and control section 42 determines whether the temperature difference is larger than 5° C. If the difference is larger than 5° C., the Step S8-3-1 is executed. Conversely, if the difference is smaller than 5° C., the Step S8-4 is executed.

At the Step S8-3-1, the arithmetic and control section 42 sends a signal to the fuel adjusting circuit 20*a* for increasing the combustion amount of the heating burner 20*b* by two levels (two steps) and, upon receiving this signal, the fuel adjusting circuit 20*a* causes the heating burner 20*b* to increase the combustion amount of the heating burner 20*b* by two levels.

At the Step S8-4, the arithmetic and control section 42 sends a signal to the fuel adjusting circuit 20*a* for increasing the combustion amount of the heating burner 20*b* by one level (one step) and, upon receiving this signal, the fuel adjusting circuit 20*a* causes the heating burner 20*b* to increase the combustion amount of the heating burner 20*b* by one level.

After the above Step S8-1-1, Step S8-2-1, Step S8-3-1 and Step S8-4 have been executed, the Step S9 (measurement of the heated air temperature of the heated air path) is executed.

At the Step S9, the heated air temperature of the drying burner section 32 is detected by the drying section temperature sensor 26, and the detected temperature data are inputted into the arithmetic and control section 42 through the A/D converter 41 and the input/output circuit 40.

Next, the arithmetic and control section 42 determines whether the water content values of the grains detected by the Step S4 is smaller than 20%. If it is not smaller than 20%, the Step S11 is executed and, if it is smaller than 20%, the Step S10-1 is executed (Step S10).

At the Step S10-1, the arithmetic and control section 42 calculates, based on the water content value stored in the RAM 46, the difference in the water content value as of the time after the lapse of a predetermined time, and derives a value (drying speed value) by dividing the calculated difference in the water content value by such predetermined time, and further multiplying by 60. Next, at the Step S10-2, it is determined whether such drying speed value corresponds to any of the classes of the drying speed values set and stored in advance in the ROM 43. The arithmetic and control section 42 changes the setting of the heated air setting temperature TB of the heated air path 22 based on the heated air temperature compensation values of the heated air path 22 set correspondingly to the respective classes and stored in advance in the ROM 43.

Next, at the Step S11, the arithmetic and control section 42 determines whether the heated air temperature of the heated air path 22 is "in accord" with the heating air setting temperature TB set in advance. If the result is "out of accord",the Step S11-1 is executed and, if the result is "in accord",the Step S12 is executed.

At the Step S11-1, the determination is made as to whether the heated air of the heated air path 22 is larger than the heated air setting temperature TB. If the heated air temperature is larger than the heated air setting temperature TB, the Step S11-1-1 is executed and, if the heated air temperature is smaller than TB, the Step S11-2 is executed.

At the Step S11-1-1, the arithmetic and control section 42 sends a signal to the fuel adjusting circuit 32*a* for decreasing the combustion amount of the drying burner 32*b* by one level (one step) and, upon receiving this signal, the fuel adjusting circuit 32*a* causes the drying burner 32*b* to decrease the combustion amount of the drying burner 32*b* by one level.

At the Step S11-2, the arithmetic and control section 42 calculates the temperature difference between the detected heated air temperature and the heated air setting temperature TB and determines whether such temperature difference is larger than 10° C. If the difference is larger than 10° C, the Step S11-2-1 is executed. Conversely, if the difference is smaller than 10° C., the Step S11-3 is executed.

At the Step S11-2-1, the arithmetic and control section 42 sends a signal to the fuel adjusting circuit 32*a* for increasing the combustion amount of the drying burner 32*b* by three levels (three steps) and, on receiving this signal, the fuel adjusting circuit 32*a* causes the drying burner 32*b* to increase the combustion amount of the drying burner 32*b* by three levels.

At the Step S11-3, the arithmetic and control section 42 determines whether the temperature difference is larger than 5° C. If the difference is larger than 5° C., the Step S11-3-1 is executed. Conversely, if the difference is smaller than 5° C., the Step S11-4 is executed.

At the Step S11-3-1, the arithmetic and control section 42 sends a signal to the fuel adjusting circuit 32*a* for increasing the combustion amount of the drying burner 32*b* by two levels (two steps) and, upon receiving this signal, the fuel adjusting circuit 32*a* causes the drying burner 32*b* to increase the combustion amount of the drying burner 32*b* by two levels.

At the Step S11-4, the arithmetic and control section 42 sends a signal to the fuel adjusting circuit 32*a* for increasing the combustion amount of the drying burner 32*b* by one level (one step) and, upon receiving this signal, the fuel adjusting circuit 32*a* causes the drying burner 32*b* to increase the combustion amount of the drying burner 32*b* by one level.

After the above Step S11-1-1, Step S11-2-1, Step S11-3-1 and Step S11-4 have been executed, the Step S12 is executed.

Next, at the Step S12, the arithmetic and control section 42 determines whether the water content value measured at the Step S4 is below the targeted finishing water content value entered at the Step S1. If the water content value is below the targeted finishing water content value, the Step S13 is executed and, if not below, the procedure returns to the Step S4.

At the Steps S13 and S14, the arithmetic and control section 42 ends the drying operation program after causing the drying machine 5 to stop automatically.

By the drying operation control in the Steps S1 through S14, the heating section 12 of the circulating type grain drying machine 5 of the present invention maintains the temperature of the heated air supplied to each heating pipe 18 to the temperature adapted to the water content value of the grain, thus enabling to effect a preliminary heating by each heating section 12 heated by the heated air of the above temperature. On the other hand, the drying section 13 maintains the heated air supplied to each heated air path 22 at the temperature adapted to the water content value of the grain and the filling amount, and the drying can be carried out by the heated air (drying air) of the above temperature. Thus, the time required for the drying of the grains can be reduced from that conventionally required.

In order to solve the first technical problem, according to the circulating type grain drying machine, the control means causes the first heated air generating means to operate and the second heated air generating means to stop. The control means sends a signal to the exhaust airflow control section according to the outside air humidity detected by the outside air humidity detection means and, by the operation of th e exhaust airflow control section, the exhaust airflow from the air exhaust means is caused to be changed and the airflow in the drying section is changed. Thus, each heating pipe is heated by the heated air of the first heated air generating means, and the heated air turns to low temperature resulting from the mixing with the outside air introduced through the second heated air generating means which is in a stopped state, and the low temperature heated air is introduced into the drying section. Since the amount of the exhaust air from the air exhaust means is changed by the exhaust airflow control section operated according to the outside air humidity, the airflow of the low temperature heated air introduced into the drying section is changed according to the outside humidity. Thus, while flowing down between the heating pipes, the grains introduced into the drying machine are heated by the heat conduction caused by being in contact with each heating pipe and by radiating heat of each heating pipe and, while flowing down through each grain flow-down layer, the grains are exposed to the heated air which is of a low temperature, which passes through each grain flow-down layer and the airflow of which is adapted to the outside humidity, the grains are heated without being dried. Thus, it is possible to effect the preliminary heating of the grains during the grain filling filling operation in advance to the drying operation.

In order to solve the second technical problem, according to the circulating type grain drying machine, the control means controls the first heated air generating means based on the detected temperature value by the heating pipe heated air temperature detecting means so that the heated air supplied to the heating pipe becomes the temperature adapted to the grain water content value, the heating temperature of each heating pipe becomes the temperature adapted to the water content values of the grains. On the other hand, since the control means controls the second heated air generating means based on the detected temperature value detected by the drying heated air temperature detecting means so that the heated air supplied to the drying section becomes the temperature adapted to the grain water content value and the filling amount, the heated air introduced into the drying section and passed through each heating pipe is mixed with the outside air in-taken from the outside air in-taking opening and becomes the temperature adapted to the water content values and the filling amount. Further, the heating temperature of each heating pipe and the heated air temperature of the drying section are of temperatures which do not cause the deterioration of the grains such as by cracks. Thus, the grains filled in the drying machine are preliminary heated by each heating pipe heated by the temperature which is varied as the drying progresses and which is adapted to the water content of the grains. The preliminarily heated grains flow down into the drying section and, at the drying section, the heated air of the temperature adapted to the grain water content value and to the filling amount, thereby enabling the efficient drying operation and also enabling the reduction in the drying time as compared with that in the conventional machine.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A circulating type grain drying machine comprising:

a heating section for heating grains equipped with a plurality of heating pipes through which heated air from a first heated air generating means passes;

a drying section arranged under said heating section, for drying grains by supplying heated air having passed through each heating pipe together with heated air from a second heated air generating means;

an air exhaust means for sucking the heated air of said drying section and exhausting said heated air to outside the drying machine;

an exhaust airflow control section for controlling the amount of exhaust air of said air exhaust means;

an outside air humidity detection means for detecting an outside air humidity; and a control means electrically connected to each of said first heated air generating means, said second heated air generating means, said exhaust airflow control section, and said outside air humidity detection means, said control means causing, during the grain filling operation, said first heated air generating means to operate and at the same time said second heated air generating means to stop to operate, and said exhaust airflow control section to operate according to the detected outside air humidity value detected by said outside air humidity detection means and to change the exhaust airflow of said air exhaust means.

2. A circulating type grain drying machine according to claim 1, in which the airflow of said drying section during the drying operation when the exhaust airflow is not restricted by said exhaust airflow control section is used as reference and, if the outside air humidity value is above a predetermined humidity, the airflow of the air in said drying section is caused to be a first airflow which is smaller than said reference and, if the outside air humidity value is below the predetermined value, the airflow of the air in said drying section is caused to be a second airflow which is still further smaller than said first airflow and, by the operation of said exhaust airflow control section, the exhaust airflow of said air exhaust means is caused to be changed.

3. A circulating type grain drying machine according to claim 2, in which said predetermined humidity is 70%.

4. A circulating type grain drying machine comprising:

a heating section for heating grains equipped with a plurality of heating pipes through which heated air from a first heated air generating means passes;

a drying section arranged under said heating section, for drying grains by supplying heated air having passed through each heating pipe together with heated air from a second heated air generating means;

an air exhaust means for sucking the heated air of said drying section and exhausting the heated air to outside the drying machine;

a drying heated air temperature detecting means for detecting a temperature of the heated air supplied to said drying section;

a heating pipe heated air temperature detecting means for detecting a temperature of the heated air supplied to said heating pipes;

a water content detecting means for detecting water content values of grains;

an input section for inputting the amount of filled grains; and a control means electrically connected to each of said first heated air generating means, said second heated air generating means, said drying heated air temperature detecting means, said heating pipe heated air temperature detecting means, said water content detecting means and said input section, said control means controlling, during the drying operation, said first heated air generating means to change the temperature of the heated air supplied into each heating pipe according to the detected value of water content of the grains, and said second heated air generating means to change the temperature of the heated air supplied into said drying section according to the detected value of water content of the grains and the value of filled grains.

* * * * *

UNITED STATES PATENT AND TRADEMARK OFFICE

CERTIFICATE OF CORRECTION

PATENT NO. : 6,318,000 B1
DATED : November 20, 2001
INVENTOR(S) : Satoru Satake et al.

It is certified that error appears in the above-identified patent and that said Letters Patent is hereby corrected as shown below:

Column 3,
Line 15, change "s ends" to -- sends --;

Column 6,
Line 55, change "leadingin" to -- leading-in --;

Column 15,
Line 5, change "th e" to -- the --.

Signed and Sealed this

Twenty-sixth Day of March, 2002

*Attest:*

*Attesting Officer*

JAMES E. ROGAN
*Director of the United States Patent and Trademark Office*